US007726632B2

(12) United States Patent
Amengual Pericas

(10) Patent No.: US 7,726,632 B2
(45) Date of Patent: Jun. 1, 2010

(54) LATERAL IMPACT CONTAINMENT SYSTEM FOR VEHICLES, WITH HIGH ENERGY ABSORPTION AND CONTAINMENT CAPACITY

(75) Inventor: Antonio Amengual Pericas, Oviedo (ES)

(73) Assignee: Hierros Y Aplanaciones, S.A., Asturias (ES)

( * ) Notice: Subject to any disclaimer, the term of this patent is extended or adjusted under 35 U.S.C. 154(b) by 0 days.

(21) Appl. No.: 11/573,157

(22) PCT Filed: Mar. 22, 2005

(86) PCT No.: PCT/ES2005/000151

§ 371 (c)(1), (2), (4) Date: Sep. 17, 2007

(87) PCT Pub. No.: WO2006/027394

PCT Pub. Date: Mar. 16, 2006

(65) Prior Publication Data

US 2008/0067484 A1 Mar. 20, 2008

(30) Foreign Application Priority Data

Aug. 4, 2004 (ES) ..... 200401947

(51) Int. Cl.
*E01F 15/00* (2006.01)

(52) U.S. Cl. ..... 256/13.1

(58) Field of Classification Search ..... 256/13.1, 256/64, DIG. 5; 404/6
See application file for complete search history.

(56) References Cited

U.S. PATENT DOCUMENTS 523,075 A * 7/1894 Krause ..... 52/838

(Continued)

FOREIGN PATENT DOCUMENTS

EP 0216712 4/1987

(Continued)

OTHER PUBLICATIONS

International Search Report for PCT Patent Application No. PCT/ES2005/000151, dated May 20, 2005.

(Continued)

*Primary Examiner*—Daniel P Stodola
*Assistant Examiner*—Joshua T Kennedy
(74) *Attorney, Agent, or Firm*—Intellectual Property Law Group LLP; Juneko Jackson; Otto O. Lee

(57) ABSTRACT

High contention and energy absorption capacity system to contain vehicle's side impact configured by an anchoring plate, configured by a post having a base, a frontal plate and a base plate and said post affixed to the terrain at regular intervals, configured by two or more systems of continuous horizontal rails arranged longitudinally and attached to the post by a clamp placed in the inner side of the rail and also constituted by a separating device that is characterized by the post's leg to be comprised by two tubular profiles, mutually facing, the base plate of the post having frontal and lateral-rear openings that permit a certain controlled displacement of the post's leg, as a separating device between the post and the rail there is a shock-absorbing system having high energy capacity that serves to endow the system with a high capacity to absorb the energy resulting from the impact of a vehicle and allow it to be redirectioned.

20 Claims, 12 Drawing Sheets

U.S. PATENT DOCUMENTS

| | | | | |
|---|---|---|---|---|
| 1,643,555 | A * | 9/1927 | Gledhill | 256/13.1 |
| 1,849,167 | A * | 3/1932 | Bente | 256/13.1 |
| 3,276,750 | A * | 10/1966 | De Ridder | 256/13.1 |
| 3,332,666 | A * | 7/1967 | Gray | 256/13.1 |
| 4,638,979 | A * | 1/1987 | Demarest | 256/13.1 |
| 5,145,278 | A * | 9/1992 | Lohrmann | 404/6 |
| 5,553,437 | A * | 9/1996 | Navon | 52/837 |
| 5,657,966 | A * | 8/1997 | Cicinnati | 256/13.1 |
| 5,697,728 | A * | 12/1997 | Camomilla et al. | 404/6 |
| 6,129,342 | A * | 10/2000 | Bronstad | 256/13.1 |
| 6,644,888 | B2 * | 11/2003 | Ochoa | 404/6 |
| 6,840,706 | B1 * | 1/2005 | Camomilla et al. | 404/6 |
| D574,521 | S * | 8/2008 | Charette | D25/132 |
| 2004/0079932 | A1 * | 4/2004 | Hanai et al. | 256/13.1 |
| 2004/0234333 | A1 * | 11/2004 | Hinojosa | 404/6 |
| 2008/0230759 | A1 * | 9/2008 | Lass et al. | 256/13.1 |
| 2008/0283806 | A1 * | 11/2008 | Everitt et al. | 256/13.1 |

FOREIGN PATENT DOCUMENTS

| | | |
|---|---|---|
| EP | 1167628 | 1/2002 |
| FR | 2678007 | 12/1992 |
| GB | 2266910 | 11/1993 |
| GB | 2397604 | 7/2004 |

OTHER PUBLICATIONS

International Preliminary Report on Patentability for PCT Patent Application No. PCT/ES2005/000151.

* cited by examiner

LATERAL IMPACT CONTAINMENT SYSTEM FOR VEHICLES, WITH HIGH ENERGY ABSORPTION AND CONTAINMENT CAPACITY

OBJECT OF THE INVENTION

The present invention refers to a side impact vehicle detention system, with great detention and energetic absorption and redirecting capacity, for use in road safety such as safety barriers, safety rails and parapets for use on roadside rails and circulation-lane dividing rails.

STATE OF THE ART

Various types of vehicle detention systems exist in practice, understanding by this, to be all devices installed in a road in order to provide detention and redirection of a vehicle which, once out of control, goes out of the lane, thus reducing the seriousness of produced accidents in such a manner, that the damages and injuries of the occupants and of the rest of the road users is limited, together with that of other persons and objects in the vicinity.

Two of the most commercially common detention systems are metallic safety barriers, used on roadside and circulation-lane division rails, and metallic parapets, similar to the safety barriers, but specifically designed for road edges of pathway constructions (bridges, viaducts, etc), crowning of support walls and similar construction works. The object of these elements is to resist vehicle impacts, preventing crossing past them, and with this, to assure protection to third parties, and in turn, proceeding to their redirection and controlled deceleration, in such a manner, that the vehicle exits from the impact under stable conditions and continues its progress at reduced speed beside the detention system in the original traffic direction, thus assuring the safety of the vehicle occupants and that of the other road users.

According to an existing application Standard (EN 1317-2 in Europe and NCHRP 350 in U.S.A), the metallic barriers and parapets are subjected, prior to commercial use, to real impact tests in which, under controlled conditions an impact is produced between a type vehicle and a detention system, permitting a qualitative and quantitative evaluation of its behaviour. A detention system satisfactorily meets a real scale impact test when it complies with the requirements and acceptance criteria defined in the Standards as regards detention level, severity of impact, deformation and exit angle, and in consequence guarantees appropriate safety conditions, mainly for the occupants of the impacted vehicle and of third parties. It is consequently affirmed that a detention system has the capacity of containing a set type vehicle.

In accordance with said Standardization System, a system of great detention (specifically designed to receive the impact of heavy vehicles) must pass the real scale impact tests, both of heavy vehicles (lorries, buses, etc), and of light vehicles (tourisms). This makes possible, that the high detention systems also assures the safety of light vehicles that constitutes the most frequent type of accident. For example, according to the European Standard EN 1317-2, the level of high detention H3 requires the passing of the TB61 test (impact of a rigid lorry, 16,000 Kg in weight, with a speed of 80 Km/h and an impact angle against the detention system of 20°) plus the TB11 test (impact of a tourism of 900 Kg in weight, at a speed of 100 Km/f, and at an impact angle against the detention system of 20°).

In practice, the commercial detention systems present various solutions as reply to impacts both of light and of heavy vehicles that present the following problems:

On one hand, all elements that constitute the safety barriers generally have the capacity of reacting together in similar manner, by means of deformation, versus an impact, both of a light and a heavy vehicle. On the other hand, the parapets, in principle designed for collisions of greater magnitude than safety barriers, and that are equipped with reduced transversal space for deformation since they are placed on the edge of a bridge road, generally present, operational mechanism capable of different behavioural response versus impact of a light and a heavy vehicle.

The metallic safety barriers correspond to the union of three basic metallic elements:

$1^{st}$: The longitudinal fences or railing element(s) arranged horizontally at a set height and in a continuous manner, the function of which, is to detain and guide the impacting vehicle, preventing the vehicle from crossing through it, limiting the transversal deformation and guiding it in such a manner, that it may be redirected by the system in a suitable way. The railing may present different configurations: one or various longitudinal profiles with open or almost closed cross section, in the shape of a double or triple wave or in the shape of a box or "C" shape, joined, either directly to the post, or by means of a separating element; cables or metallic tensile rods, attached directly to the post; longitudinal double or triple shaped wave profiles, joined on their bottom part to metallic sheets capable of free movement and calibrated to exert a certain impact strength.

$2^{nd}$. The post, placed vertically at regular intervals and attached to the fence(s) or railing(s), the function of which is to support and maintain the fences(s) or railing(s) of the barrier at a set height during impact.

$3^{rd}$. The separator or absorber, the function of which is the joining of the railing to the attachment posts and to eventually act as attenuator or absorber of part of the impacting energy and to contribute to the redirecting of the vehicle during impact. On some occasions, this element consists of metallic flat bars or profiles of more or less complex shape, or in square or rectangular cross-sectional tubular profiles, open or closed. On other occasions, barriers can be found in which no separator or absorber exist, the railing being directly attached to the post. In other situations, especially on roads pertaining to sports race-tracks, it is possible to find other arrangements in which the absorber or separator element is made up of resistance elastic material cylinders filled with foam or similar material, placed between the railings and the post or external wall; or even by a metallic structure of the triangular semi-layered type that acts simultaneously as absorber and as post, permitting the displacement of the barrier in case of impact. Sometimes, the energy absorption capacity of a safety barrier is achieved by means of elastic adaptors in the manner of envelope placed on the fences or railings.

Metallic parapets are constructed in a somewhat more complex manner than safety barriers but they are similarly provided with the same basic elements.

$1^{st}$. The fences or railings, placed horizontally, that present a similar shape to those indicated in the safety barriers, but generally divided into two, three, four and sometime more levels.

$2^{nd}$ The post, placed vertically at regular intervals, which supports the parapet's horizontal railings and which is generally provided with tie-down mechanisms on the bridge road which, in some cases, is capable of automatically breaking only against heavy vehicle impact and remaining intact against light vehicle impact.

3rd. The absorber, separator or energy dissipater element, which id generally to be found placed between the lower level railing and the post, and which is the railing that is mainly intended to retain light vehicle impact. In the majority of cases, this separator element is in the form of flat bars or metallic profiles formed more or less elaborately, or in the form of tubular profiles with square or rectangular cross section, opened or closed.

DESCRIPTION OF THE INVENTION

The present invention provides a side impact vehicle detention System with great detention and energetic absorption capacity, which simultaneously, has the following advantageous technical characteristics as regards the State of the Art, in which the problems presented by the same are solved;

(i) great absorption capacity of the energy resulting from a vehicle impact, to provide the detention system with an elastoplasticity behaviour and with this to decrease its rigidity to prevent the detention system from causing equivalent damages or worse, than those the road users require to be protected from;

(ii) great decreasing capacity of the deceleration levels that are produced in the light vehicle during impact to decrease the severity of impact and with this, the risk of injuries to the vehicle occupants;

(iii) great control capacity over the vehicle during and after collision, reducing with this, the possibility of its subsequent undesired reactions, (turns, overturning, unexpected trajectories, etc.) and achieving an exiting trajectory as parallel as possible to the detention system, thus reducing the risk of secondary collisions of the vehicle or with other road users;

(iv) great control capacity of the absorbed energy to provide the detention system with a certain capacity of similar deformation, after each vehicle impact, and thus, contributes to extend the service life of the rest of the elements that make up the detention system;

For the above, and in order to achieve the previously indicated advantages as regards the State of the Art, it has been necessary to form a new detention system for side vehicle impacts that include the following as novelty:

A new barrier post, on which the following have been considered as main design factors a) its excellent stress resistance caused by vehicle impact both in the system or longitudinal direction, or in perpendicular system or transversal direction, b) its good capacity to transmit said stresses to the base with directed deformation capacity of the upper part to the lower part and c) its thinness which permits the obtention of reduced working width during impact, having provided as preferred solution, the attachment of two open profiles which, once assembled to each other, and with a front plate and another base plate, have a configuration consisting of two tubular spaces that present notable efficiency, with tensile and flexure strength, and which independently from its good impact and resulting energy absorption behaviour, present considerable advantages related to greater manufacturing and production facility, eliminating an oversize structure that does not justify its behaviour in both directions. All the above, has resulted in a new post with good resulting energy absorption behaviour, reducing its rigidity, and being in turn, more economical, aesthetic and stylized.

An energy absorber, made up of tubular elements with axes orientated in perpendicular direction to the system and assembled by its ends between two plates in such a manner, that the tubular elements are axially deformed, collapsing during light vehicle impact, with its new attachment of said absorber to the abutments and post, having performed access-openings with vertical apertures on the absorbed plates that permit manual access to the union by means of nuts and spherical headed and square necked screws.

New attachment mechanism of the abutment to the post, by means of spherical headed, square necked screws and square openings on the abutment. The abutment-screw union is achieved by means of friction between the square opening walls and the four side faces of the screw neck.

A new mechanism that permits, during vehicle impact, a certain transversal displacement of the post as regards the tiedown on the bridge panel, wall, slab or similar structure, consisting on the providing of holes on the base plate of the post, with elongated shape in transversal or perpendicular direction to the system, that are crossed through by their corresponding screws for union between it and the tiedown. The screws form rigid, integral part of the bridge road, and consequently, remain unmovable during light vehicle impact and until its fusion during impact with heavy vehicles.

Fusible templates for placement of the post, the object of which is to maintain the initial position of the post and to permit, during light vehicle impact, a certain transversal displacement of the post by means of the bending of lugs, for that purpose.

Safety attachment of the top abutment or of any other, to the post by means of a safety cable that maintains the post joined to the abutment during heavy vehicle impact once the post has been separated from the tiedown, thus preventing that the post be totally pulled off from the system during or after impact.

PREFERRED EMBODIMENT DESCRIPTION OF THE INVENTION

Figure 1:
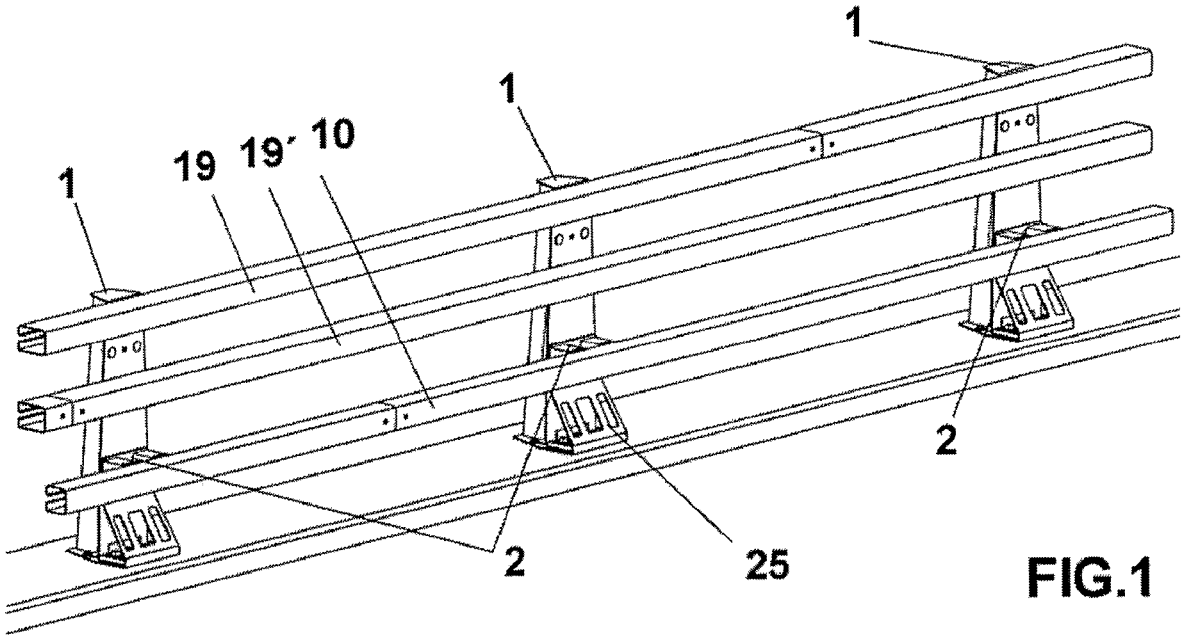
FIG. 1 corresponds to a side view of a section of the system with various railings and posts.
Figure 2:
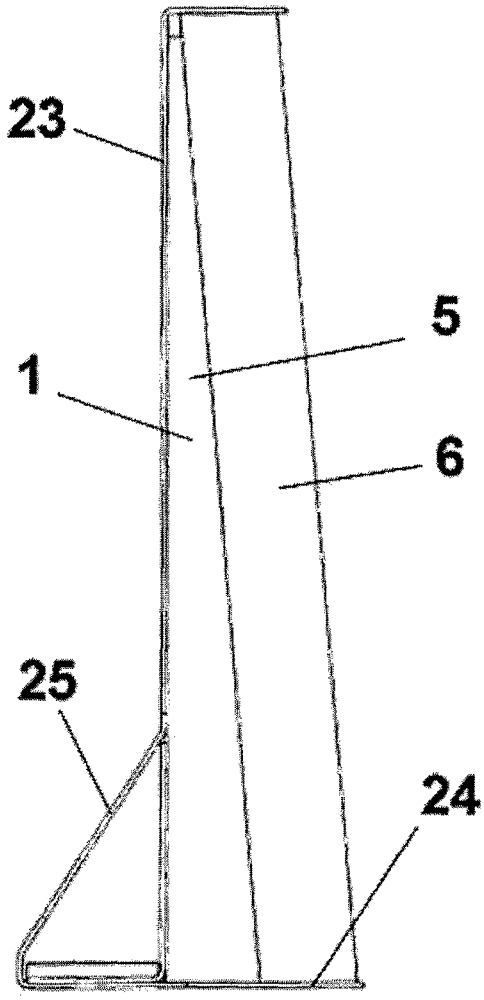
FIG. 2 corresponds to a side view of the post
Figures 3A, 3B:
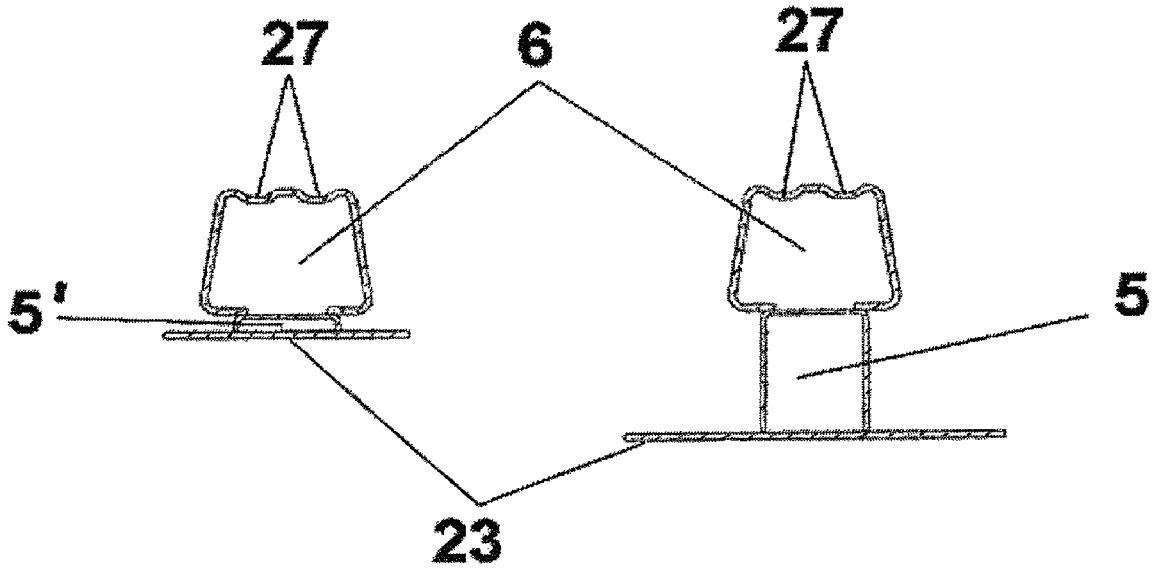
FIGS. 3A and 3B are the top and bottom section of the post of FIG. 2.
Figure 4:
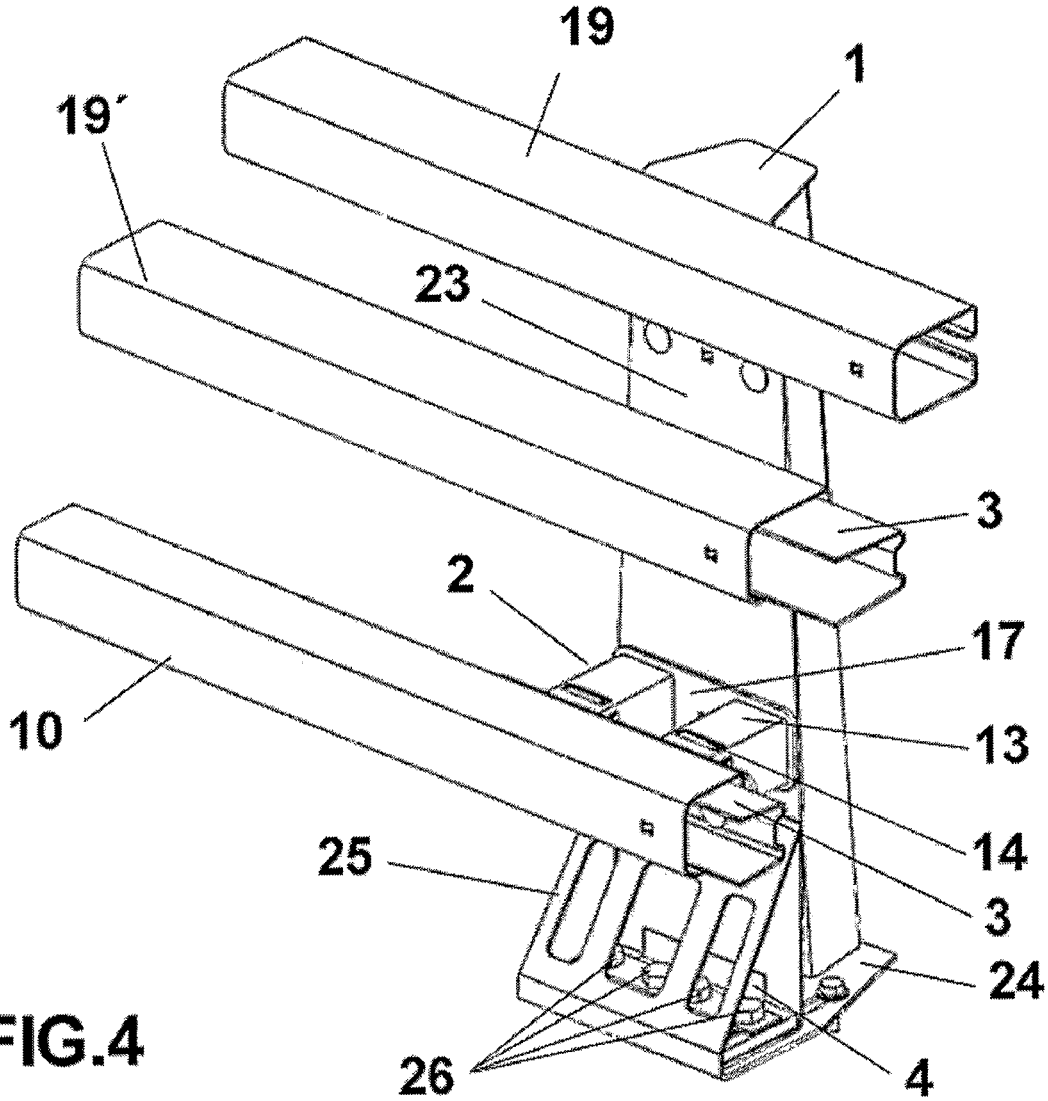
FIG. 4 are exploded views of the post assembly with railing, abutment fastened to the post and safety attachment with cable, and absorber with attachment devices.
Figure 5:
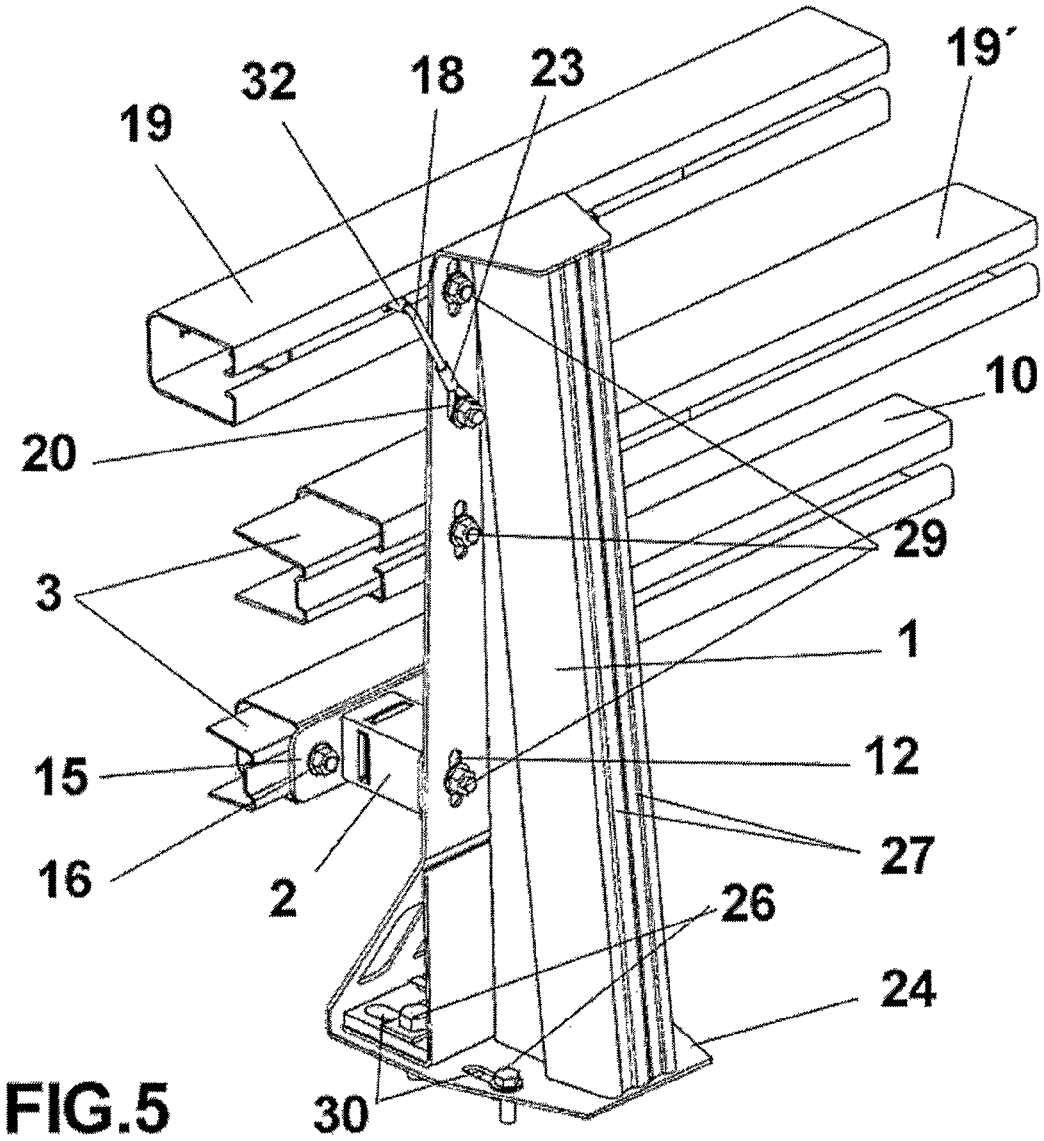
FIG. 5 is an exploded view of the total assembly
Figure 6:
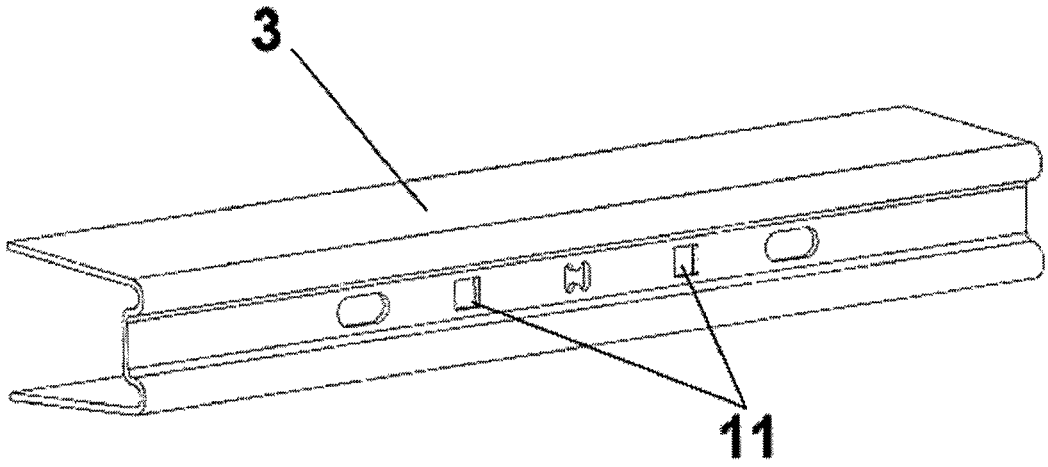
FIG. 6 is a perspective view of the abutment

The present invention offers a side impact detention system for Vehicles, constituted by one or various levels of longitudinally placed, continuous, horizontal railings, and of vertical support posts, placed at regular intervals, that is characterized in that it comprises:

One post (1), one absorber (2), parapets (3) and fusible template (4).

The post (1) is preferably formed by a front sheet (23), a base plate (24) and a foot or strut formed by two tubular profiles, configured as from corresponding inverted "U"-shaped (5) or "C"-shaped trapezoidal (6) cross sectional open profiles, joined to the front sheet (23) that forms a nose (25) on the lower part, inside of which are housed the fastener screws (26) to the tiedown and also fastened to a base plate (24), on which one of the profiles (6) are maintained constant in its section, as regards its longitudinal axis, from its top base to the bottom one, and preferable presents, on its rear face, one or various longitudinal ribs (27) that improve the warp deformation strength of the profile on its lower part, while the other, on its bottom base, adopts the shape represented in (5), while on the top base, it adopts shape (5'), due to which, as regards its longitudinal axis, its sides are sloped, as a projection of its top base to the bottom, and which has the consideration that such as it has been conceived and placed, it suitably absorbs and transmits the tensile and flexure stresses, and which, due to its thinness, is achieved with reduced working width (a width which is the result of adding the width of the actual system to the greater transversal deformation of the system during vehicle impact), which is considered as a favourable situation versus impacts, since it transmits the stresses of the top part to the bottom part, or in other words, it improves the transmission of loads to the base, where the railings are less deformed, and the elastoplasticity behaviour is of considerable efficiency. Additionally, since it is made up of two elements or profiles, a great facility in its manufacturing and production has been achieved, which is translated into an aesthetic, and economic assembly of reduced width.

The post (1) presents appropriate fastening means, by use of screwed fasteners (29) that cross through the front sheet (23) of the post, to permit the assembly of an undetermined number of profiles or railings (10) at different heights, in order to consider posts of different heights and to prevent impacts both of heavy vehicles with high centres of gravity and of tourisms with mostly lower centres of gravity.

The post is provided, on its lower tiedown part and on the inside of the nose (25) with a template (4), with wing (7) at a 90° angle, on which two rectangular openings (8) have been performed on its base for its fastening with screws (26) to the tiedown and with two lugs (9).

Figure 7:
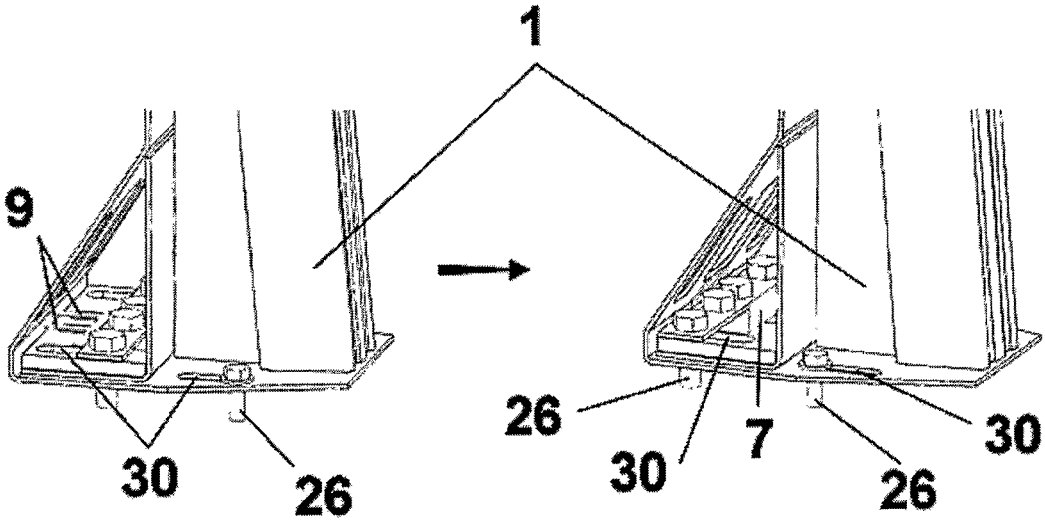
FIG. 7 are perspective views in which the displacement of the post foot and the bending of the fusible lugs can be observed.
Figure 8:
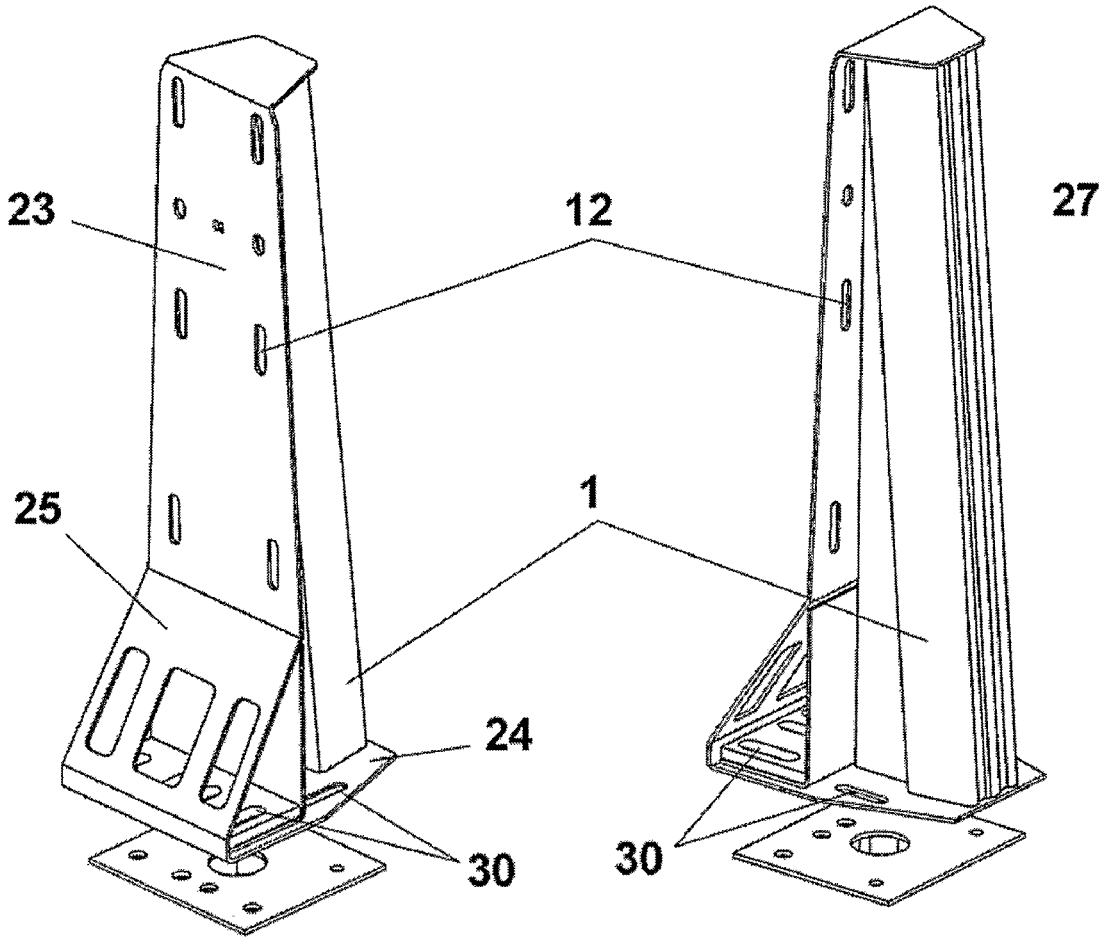
FIG. 8 are perspective views of the post ad of the tie down plate
Figure 9:
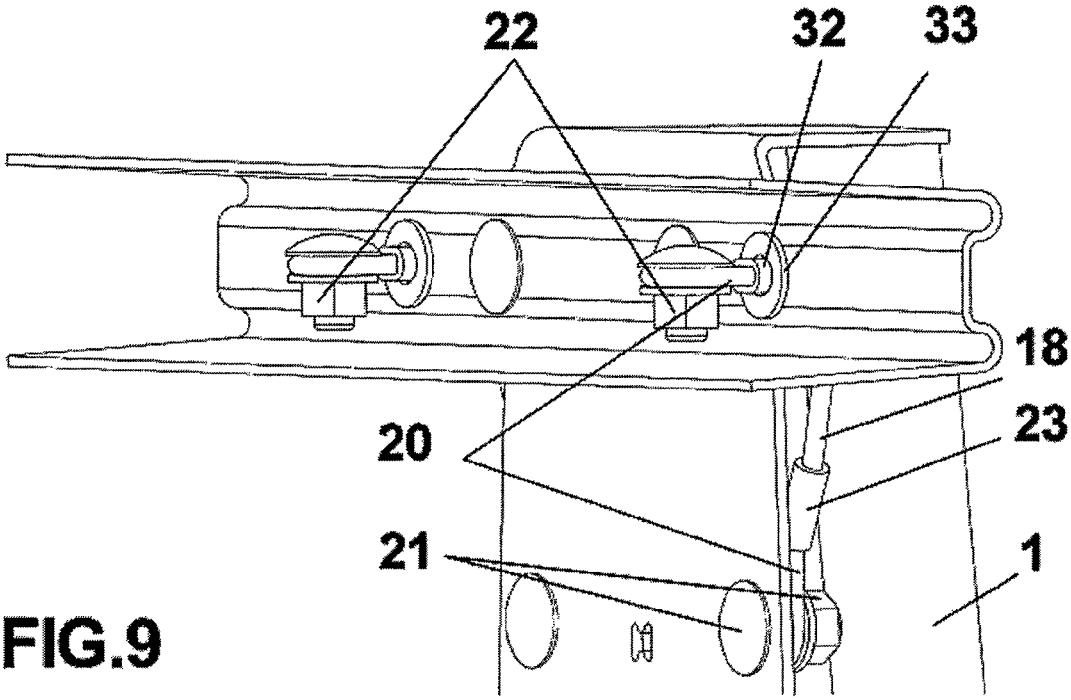
FIG. 9 is a perspective view of the safety attachment by means of the post cable and top abutment.
Figure 10:
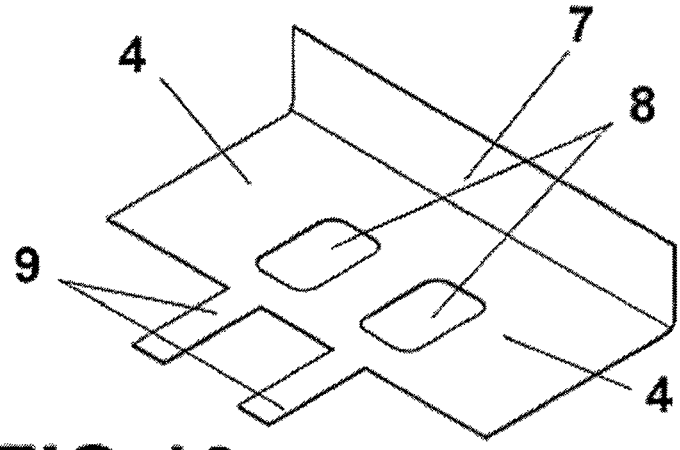
FIG. 10 is a perspective view of the fusible template.
Figure 11:
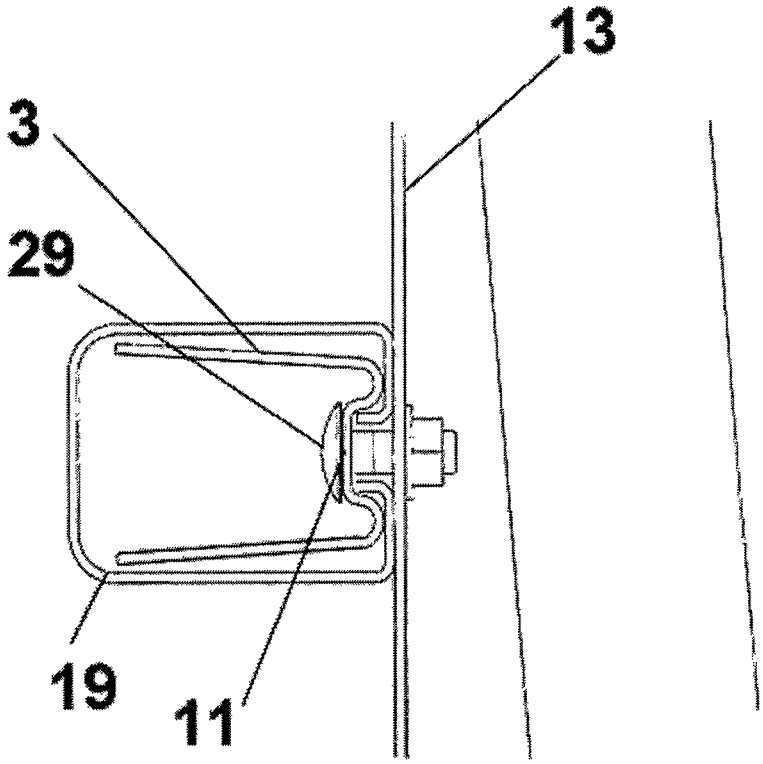
FIG. 11 is a cross section of the abutment on which the square headed and round necked screw can be observed, crossing though the abutment opening and remaining attached by the same by means of friction between the side opening walls the side faces of the screw neck.

On one side, said template (4) attaches and initially positions the post, and wing (7) or flange, places it always in appropriate position, and on the other hand, it acquires the character of being fusible since it permits a certain displacement of the foot of the post versus the impact of a light vehicle, being subjected to deformation on the lugs (9) which bend, such as can be observed in FIG. 7.

When impact of a vehicle against the system is produced, the post moves transversally along a certain distance, due to the fact that the lugs bend against the internal wall of the tiedown nose, and this movement of the post keeps it away from the wheels of the vehicle, thus preventing risk of the wheel engaging with the post.

The railings (19) and (19') are attached to the posts (1) by means of their internal abutments (3), on which square openings (11) have been performed in order to receive by pressure, round headed and square necked screws (29) which are fastened with the corresponding nut through the post. The pressure fastening between the abutment (3) and the screw (29) is established between walls of the square opening (11) of the abutment and the four side faces of the screw neck.

The lower railing (10) is attached to the post by means of its corresponding abutment (3) plus an intermediate absorber (2), on which, on its rear plate, square openings (31) have been performed, which, together with those performed (11) on the abutment (3), house, under pressure, rounded headed and squared necked screws (29), which, through openings (12) performed on the post, receive the corresponding fastener nuts and washers.

The absorber (2) is sandwiched between an external and independent horizontal element, intended to receive impacts, such as the railing or profile (10) and another external and independent vertical elements, intended to serve as support and attachment, such as the post (1).

Figure 12:
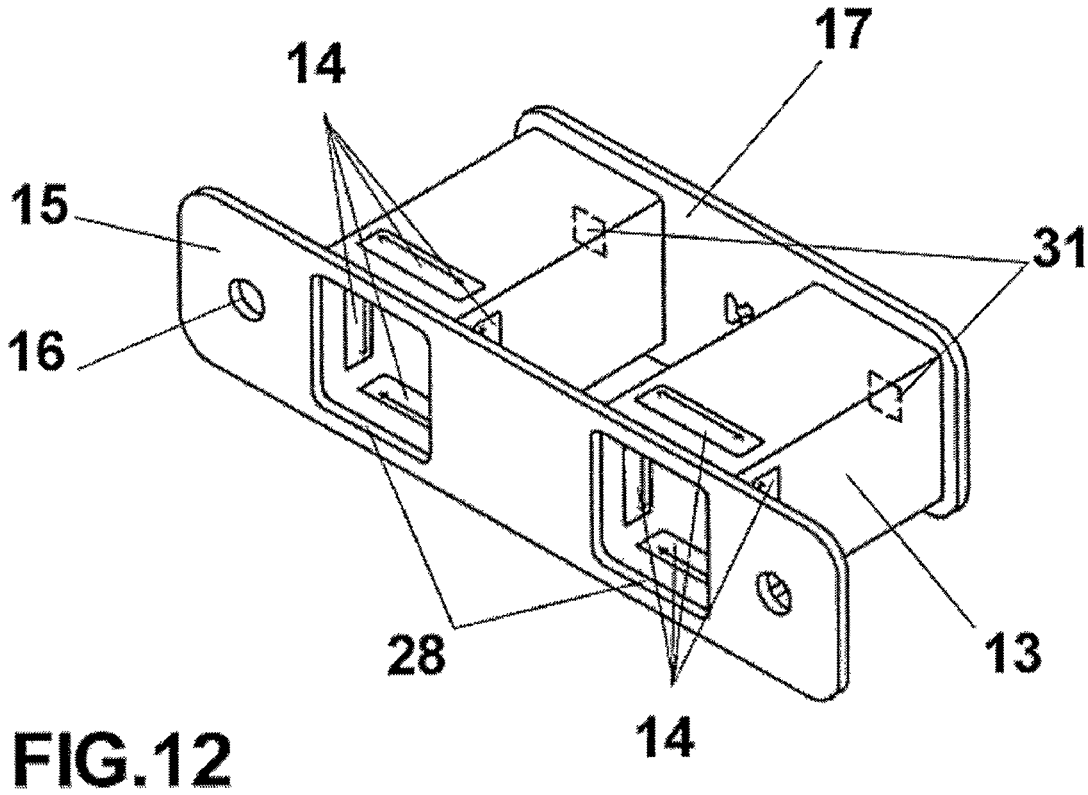
FIG. 12 is a perspective view of the absorber, in which the tubes, plates and attachment systems to the post and abutments, can be observed

The absorber (2) is made up of one or various hollow tubular metallic elements (13), with the same length. They are preferable of square cross section and are placed with their axes parallel to each other, and with their upper and lower faces parallel as regards the horizontal line, presenting on their faces, notches or crevices (14), preferably, in outward direction to the tubular elements, and are joined to each other on their front part by means of rectangular metallic flat bars (15), that present holes (16) on their surface in order to be crossed through by the fastener screw with the abutment and also, corresponding openings (28), preferably square, which correspond respectively to the internal gap of the tubular metallic elements (13) the object of which is to permit access to the union between absorber and front sheet of the post (23)—which is situated inside the tubular metallic elements (13) and which cross through the rear rectangular flat bar (17). The hollow tubular metallic elements (13) are joined to each other on their rear part by means of rectangular metallic flat bars (17) with holes (31) on their surface, preferably with square cross section, and that are crossed through by fastener screws of the absorber to the front sheet of the post (29), as is reflected in FIG. 12.

When impact of a vehicle occurs, the tubular elements (13) act as absorption pivots, providing a greater absorption area to the detention system as well as a greater canalization and absorbed energy distribution capacity in the structure of the absorber elements. During impact, the tubular elements (13) of the absorber fold up exactly along their notches or crevices (14), as an accordion, providing the detention system with a certain facility of similar deformation at each vehicle impact, preventing unforeseen behaviour, facilitating the redirecting of the vehicle and thus contributing to extend the service life of the rest of the elements that constitute the detention system.

With the purpose of maintaining the initial position of the post, a template (4) is provided inside the internal gap of nose (25) of the front sheet (23) of the post, the template having an angular profile with a front horizontal, flat part on which elongated holes (8) are preferably performed and one or various lugs (9) and with a vertical wing or flange (7) on its rear part that only permits one position of the template in the internal gap of the nose (25). The template (4) is horizontally placed over the base plate of the post (24) and below the heads or nuts of the tiedown screws (26) in such a way, that one or some of the same, cross through the elongated holes (8) of the template.

When impact is produced, the post (1) moves transversally along a certain distance due to the transversal gap of the elongated holes (30) of the base plate (24) of the post, that are crossed through by tiedown screws (26) which remain fixed on the tiedown and, in consequence, immovable during impact, and due to the fact that the lugs (9) of the template (4) bend against the internal front wall of the nose (25) (See FIG. 7), leaving a certain relative freedom of transversal movement between the base plate and the tiedown screws.

This certain transversal displacement of the post (see FIG. 7) during vehicle impact achieves a reduction of the severity of impact of the light vehicle since it decreases the rigidity of the first contact, at the same time that it maintains the post away from the wheels of the vehicle, thus reducing risk of its engagement with the post and also contributing to help the redirecting of the vehicle, which, as a consequence of the contact of its front part with the post, starts a rotation movement around the centre of gravity of the vehicle in the direction of its redirection.

The redirection of the light vehicle and the final reduction of the severity of the first impact by means of energy absorption are completed with the deformation of the hollow tubular metallic elements (13) of the absorber (2) which is generally produced after the post (1) displacement.

During the impact of a heavy vehicle, once the post (1) has been transversally displaced and the absorber (2) is completely deformed, the tiedown screws (26) are generally cut and leave the post uncoupled as regards the tiedown, with the post joined only to the railings (10), (19), and (19') by means of internal abutments (3), the same being capable of separation due to the break of the corresponding unions to the round headed and square necked screws (19) and consequently, totally separating the post from the system, said post possibly detaching at great speed with the consequent road safety risk.

In order to prevent the post (1) from detaching from the system during impact of a heavy vehicle, under the circumstances that their unions have been cut from the same with the tiedown and with the abutments, all this as a consequence of the stresses transmitted by the vehicle to the system, there are provided one or various safety cables (18), with two eyelets (20) at the ends, formed by fastener bushings (23) that preferably join the internal abutment of the top railing (19) and the post (1), in such a manner, that the fastening to the post (1) is performed by one of the eyelets that is fastened by means of a bolt and thread with washer (21) in the oval hole performed in the post, with the larger axis in vertical position, and the fastening to the abutment is carried out by means of holes, also with oval shape, with the larger axis in horizontal position, with bolt and thread for attachment of the eyelet that is formed by means of the fastener bushing (32) with washer (33) that in turn is for attachment, since it can cross through the eyelet in horizontal direction, but when rotated, stops against the oval hole walls, thus producing the tiedown of the bushing in the abutment.

The invention claimed is:

1. A shock absorbing system of high contention and energy absorption capacity to contain a vehicular impact, the system comprising:

a plurality of posts, each post having a strut, a frontal plate and a base plate, said posts affixed to a terrain at regular intervals, two or more systems of continuous horizontal rails arranged longitudinally and attached to the frontal plate of the post by a clamp placed on an inner side of each rail, the strut of each post being formed by two distinct tubular profiles along a vertical length of the post to define a separating device, one tubular profile in front of and facing the other tubular profile, welded to each other and welded to the frontal plate, wherein the tubular profile positioned nearest the frontal plate has a U-shaped cross section defined by a base and a pair of spread wings extending therefrom such that free ends of the spread wings are welded to the frontal plate, and the other tubular profile has a trapezoidal-shaped cross section, the cross section of the trapezoidal-shaped tubular profile is constant along its entire length and with a vertical axis of the trapezoidal-shaped tubular profile tilted slightly towards the frontal plate which serves as an area that receives the vehicular impact, while the cross section of the U-shaped tubular profile decreases in width along its length from a bottom of the post to a top in such a manner that its wings reach a maximum width at the bottom which is greater than a width of the wings at the top of the post having a shortest width, and wherein on and along an entire length of a rear side of the trapezoidal-shaped tubular profile comprises one or more parallel, longitudinally extending ridges.

2. The shock absorbing system of high contention and energy absorption capacity to contain a vehicular impact according to claim 1, wherein the base plate of each post comprises a plurality of frontal openings that are parallel to each other and a plurality of rear-side openings parallel to each other, and all the openings extend transversally to the post, contained in the same horizontal plane and perpendicular to the post, all said openings traversed by a plurality of anchoring screws that secure the base plate of the post, leaving a portion of relative transversal freedom of movement between the base plate of the post and the anchoring screws, such that upon receiving the vehicular impact, the anchoring screws remain fixed on the post while the base plate of the post displaces transversally in relation to the anchoring screws, thereby achieving a reduction of a severity of the vehicular impact as the post becomes displaced.

3. The shock absorbing system of high contention and energy absorption capacity to contain a vehicular impact according to claim 2, further comprising a positioning template placed horizontally on the base plate that serves to initially fix and position the post during an assembly stage and allows the post to have a controlled displacement path, the positioning template comprising a flat section parallel to the base plate having two or more elongated openings in the flat section, the openings serve as through holes to insert the anchoring screws, a vertical flange extending at a 90 degree angle from a side of the flat section, and one or more legs extending from another side of the flat section opposite the vertical flange, wherein the legs suffer a deformation caused by the vehicular impact-such that the one or more legs bending and allowing the controlled displacement of the post that is sufficient to prevent breakage.

4. The shock absorbing system of high contention and energy absorption capacity to contain a vehicular impact according to claim 2, wherein each clamp that secures the inner side of the rails to the frontal plate of the post is fitted with a plurality of squared shaped windows that serve to receive a plurality of pressure inserted screws, each screw having a square stem, such that each square shaped window having a plurality of inner side walls exerting pressure on each of a side of the inserted square stem of a screw, each screw affixed to the clamp with a corresponding nut and a washer through the frontal plate of the post.

5. The shock absorbing system of high contention and energy absorption capacity to contain a vehicular impact according to claim 2, further comprising a shock-absorbing component as a separating element, placed between the post and a rail, with a high energy absorption capacity, the shock-absorbing component comprising one or more hollow tubular elements of equal length having an axis oriented in a horizontal direction and perpendicular to the post, the one or more tubular elements aligned in parallel and placed approximately in alignment with a height of a middle horizontal axis of the rail.

6. The shock absorbing system of high contention and energy absorption capacity to contain a vehicular impact according to claim 5, wherein the one or more hollow tubular elements, hereinafter referred to as the tubular elements, are secured between two corresponding flat bars, wherein one flat bar, hereinafter referred to as a front bar, is affixed to the rail on a side facing the post and affixed to a front surface of the tubular elements, and the other flat bar, hereinafter referred to as a rear bar, is affixed to the frontal plate of the post on a side facing the rail and affixed on a rear surface of the tubular elements, such that the tubular elements are secured in a sandwich configuration between the front bar and the rear bar, and wherein the front bar has corresponding openings that correspond to a shape of a hollow inside portion of each of the tubular elements, the openings providing access through the hollow inside portion to a point where the rear surface of the tubular elements is affixed to the frontal plate of the post, and the rear bar having corresponding holes drilled in it for joinder of the rear surface of the tubular elements with the frontal plate of the post.

7. The shock absorbing system of high contention and energy absorption capacity to contain a vehicular impact according to claim 1, further comprising a positioning template placed horizontally on the base plate that serves to initially fix and position the post during an assembly stage and allows the post to have a controlled displacement path, the positioning template comprising a flat section parallel to the base plate having two or more elongated openings in the flat section, the openings serve as through holes to insert the anchoring screws, a vertical flange extending at a 90 degree angle from a side of the flat section, and one or more legs extending from another side of the flat section opposite the vertical flange, wherein the legs suffer a deformation caused by the vehicular impact-such that the one or more legs bending and allowing the controlled displacement of the post that is sufficient to prevent breakage.

8. The shock absorbing system of high contention and energy absorption capacity to contain a vehicular impact according to claim 7, wherein each clamp that secures the inner side of the rails to the frontal plate of the post is fitted with a plurality of squared shaped windows that serve to receive a plurality of pressure inserted screws, each screw having a square stem, such that each square shaped window having a plurality of inner side walls exerting pressure on each of a side of the inserted square stem of a screw, each screw affixed to the clamp with a corresponding nut and a washer through the frontal plate of the post.

9. The shock absorbing system of high contention and energy absorption capacity to contain a vehicular impact according to claim 7, further comprising a shock-absorbing component as a separating element, placed between the post and a rail, with a high energy absorption capacity, the shock-absorbing component comprising one or more hollow tubular elements of equal length having an axis oriented in a horizontal direction and perpendicular to the post, the one or more tubular elements aligned in parallel and placed approximately in alignment with a height of a middle horizontal axis of the rail.

10. The shock absorbing system of high contention and energy absorption capacity to contain a vehicular impact according to claim 9, wherein the one or more hollow tubular elements, hereinafter referred to as the tubular elements, are secured between two corresponding flat bars, wherein one flat bar, hereinafter referred to as a front bar, is affixed to the rail on a side facing the post and affixed to a front surface of the tubular elements, and the other flat bar, hereinafter referred to as a rear bar, is affixed to the frontal plate of the post on a side facing the rail and affixed on a rear surface of the tubular elements, such that the tubular elements are secured in a sandwich configuration between the front bar and the rear bar, and wherein the front bar has corresponding openings that correspond to a shape of a hollow inside portion of each of the tubular elements, the openings providing access through the hollow inside portion to a point where the rear surface of the tubular elements is affixed to the frontal plate of the post, and the rear bar having corresponding holes drilled in it for joinder of the rear surface of the tubular elements with the frontal plate of the post.

11. The shock absorbing system of high contention and energy absorption capacity to contain a vehicular impact according to claim 1, wherein each clamp that secures the inner side of the rails to the frontal plate of the post is fitted with a plurality of squared shaped windows that serve to receive a plurality of pressure inserted screws, each screw having a square stem, such that each square shaped window having a plurality of inner side walls exerting pressure on each of a side of the inserted square stem of a screw, each screw affixed to the clamp with a corresponding nut and a washer through the frontal plate of the post.

12. The shock absorbing system of high contention and energy absorption capacity to contain a vehicular impact according to claim 11, further comprising a shock-absorbing component as a separating element, placed between the post and a rail, with a high energy absorption capacity, the shock-absorbing component comprising one or more hollow tubular elements of equal length having an axis oriented in a horizontal direction and perpendicular to the post, the one or more tubular elements aligned in parallel and placed approximately in alignment with a height of a middle horizontal axis of the rail.

13. The shock absorbing system of high contention and energy absorption capacity to contain a vehicular impact according to claim 12, wherein the one or more hollow tubular elements, hereinafter referred to as the tubular elements, are secured between two corresponding flat bars, wherein one flat bar, hereinafter referred to as a front bar, is affixed to the rail on a side facing the post and affixed to a front surface of the tubular elements, and the other flat bar, hereinafter referred to as a rear bar, is affixed to the frontal plate of the post on a side facing the rail and affixed on a rear surface of the tubular elements, such that the tubular elements are secured in a sandwich configuration between the front bar and the rear bar, and wherein the front bar has corresponding openings that correspond to a shape of a hollow inside portion of each of the tubular elements, the openings providing access through the hollow inside portion to a point where the rear surface of the tubular elements is affixed to the frontal plate of the post, and the rear bar having corresponding holes drilled in it for joinder of the rear surface of the tubular elements with the frontal plate of the post.

14. The shock absorbing system of high contention and energy absorption capacity to contain a vehicular impact according to claim 1, further comprising a shock-absorbing component as a separating element, placed between the post and a rail, with a high energy absorption capacity, the shock-absorbing component comprising one or more hollow tubular elements of equal length having an axis oriented in a horizontal direction and perpendicular to the post, the one or more tubular elements aligned in parallel and placed approximately in alignment with a height of a middle horizontal axis of the rail.

15. The shock absorbing system of high contention and energy absorption capacity to contain a vehicular impact according to claim 14, wherein the one or more hollow tubular elements are secured between two corresponding flat bars wherein one flat bar, hereinafter referred to as a front bar, is affixed to the rail on a side facing the post and affixed to a front surface of the one or more tubular elements, and the other flat bar, hereinafter referred to as a rear bar, is affixed to the frontal plate of the post on a side facing the rail and affixed on a rear surface of the one or more tubular elements, such that the one or more tubular elements are secured in a sandwich configuration between the front bar and the rear bar.

16. The shock absorbing system of high contention and energy absorption capacity to contain a vehicular impact according to claim 15, wherein the front bar has corresponding openings that correspond to a shape of a hollow inside portion of each of the one or more hollow tubular elements, the openings providing access through the hollow inside portion to a point where the rear surface of the one or more tubular elements is affixed to the frontal plate of the post, and the rear bar having corresponding holes drilled in it for joinder of the rear surface of the hollow tubular elements with the frontal plate of the post.

17. The shock absorbing system of high contention and energy absorption capacity to contain a vehicular impact according to claim 14, wherein the one or more hollow tubular elements have triangular, trapezoidal or semicircular slits on an outer surface, the slits parallel to each other and perpendicularly oriented to an axis of the tubular elements, placed in an arrangement, in such a manner that the slits serve to facilitate and guide a collapsing of the hollow tubular element along its axis upon vehicular impact and thus serve to lessen the effects of said impact.

18. The shock absorbing system of high contention and energy absorption capacity to contain a vehicular impact according to claim 14, wherein the one or more hollow tubular elements have a square, rectangular or circular section and are arranged between the post and the rail, with the center of a base of each tubular element placed equally not aligned and rotatable on their own axis, in order to avoid an accumulation of elements that habitually are deposited when such system is left exposed to outdoor conditions.

19. The shock absorbing system of high contention and energy absorption capacity to contain a vehicular impact according to claim 14, wherein a configuration of the system is scaled down at a height of a lower first rail, such that the frontal plate of the post and the wings of the U-shaped profile of the strut of the post secured to said plate are reduced, forming a trapezoidal shape that serves to house the shock-absorbing system, reducing a distance between the lower rail and other rails and a distance to a vertical line of the post, and therefore reducing a space available for deformation of the shock-absorber component.

20. The shock absorbing system of high contention and energy absorption capacity to contain a vehicular impact according to claim 1, further comprising one or more safety cables, each cable having two eyelets one on each end of the cable, each eyelet fitted with a socket that serves to fasten and secure the eyelet, the one or more safety cables joining a clamp to the post in such a manner that for each cable, one eyelet of the cable, hereinafter referred to as a first eyelet, is affixed to the post through engagement around a bolt having a rounded or spherical head and having a corresponding nut and washer, where the first eyelet is bolted through a first oval opening on the frontal plate of the post with the first oval opening having a longer axis running vertically, the other eyelet of the cable, hereinafter referred to as a second eyelet, is affixed to the clamp having its socket and a washer securing the second eyelet in place, such that the second eyelet engages a bolt with a corresponding nut with washer, the second eyelet and its socket are introduced through a second oval opening in the clamp, the second oval opening having a longer axis running horizontally on the clamp, wherein upon a rotation, the second eyelet abuts against edges of the second oval opening and the washer acts as a stop, thus achieving a securing of the socket so it remains in place.

* * * * *